US008191646B2

(12) United States Patent
Kinnari et al.

(10) Patent No.: US 8,191,646 B2
(45) Date of Patent: Jun. 5, 2012

(54) METHOD FOR PROTECTING HYDROCARBON CONDUITS

(75) Inventors: Keijo J. Kinnari, Stavanger (NO); Catherine Labes-Carrier, Stavanger (NO); Knud Lunde, Stavanger (NO); Leif Aaberge, Stavanger (NO)

(73) Assignee: Statoil ASA, Stavanger (NO)

( * ) Notice: Subject to any disclaimer, the term of this patent is extended or adjusted under 35 U.S.C. 154(b) by 41 days.

(21) Appl. No.: 12/224,935

(22) PCT Filed: Mar. 14, 2007

(86) PCT No.: PCT/GB2007/000897

§ 371 (c)(1),
(2), (4) Date: Feb. 27, 2009

(87) PCT Pub. No.: WO2007/104984

PCT Pub. Date: Sep. 20, 2007

(65) Prior Publication Data

US 2009/0321082 A1 Dec. 31, 2009

(30) Foreign Application Priority Data

Mar. 16, 2006 (GB) ..... 0605323.5

(51) Int. Cl.
*E21B 41/02* (2006.01)

(52) U.S. Cl. ..... 166/401; 95/153

(58) Field of Classification Search ..... 166/263, 166/300, 272.2, 272.6, 401, 270, 279; 95/153
See application file for complete search history.

(56) References Cited

U.S. PATENT DOCUMENTS

| | | | | |
|---|---|---|---|---|
| 2,217,749 | A | 10/1940 | Hewitt | |
| 2,658,460 | A | 11/1953 | Davis | |
| 3,514,274 | A | 5/1970 | Cahn | |
| 3,528,218 | A | 9/1970 | McDonald | |
| 4,007,787 | A | 2/1977 | Cottle | |
| 4,042,033 | A | 8/1977 | Holland et al. | |
| 4,399,868 | A | 8/1983 | Richardson et al. | |
| 4,456,067 | A * | 6/1984 | Pinner, Jr. | 166/279 |
| 4,625,803 | A | 12/1986 | Walhaug et al. | |

(Continued)

FOREIGN PATENT DOCUMENTS

EA 200700430 9/2005

(Continued)

OTHER PUBLICATIONS

Davalth et al., "Bijupira Salema: Flow Assurance Analysis to Support Operation Strategy," Offshore Technology Conference, OTC 16692, 2004, Presentation at the Offshore Technology Conference in Houston, Texas May 3-6, 2004.

(Continued)

*Primary Examiner* — Shane Bomar
*Assistant Examiner* — Kipp Wallace
(74) *Attorney, Agent, or Firm* — Ballard Spahr LLP

(57) ABSTRACT

A method of protecting a hydrocarbon conduit during a period of reduced hydrocarbon flow is disclosed, where nitrogen is introduced into the conduit at a pressure of 1 to 350 bar g and at a rate of (1.5 to 35)A kg/sec (where A is the internal cross sectional area of the conduit in square meters) for a period of t hours where t=(p×d)/n where d is the length in km of the conduit from the nitrogen introduction location and n is 10 to 400.

10 Claims, 2 Drawing Sheets

U.S. PATENT DOCUMENTS

Figure 1:
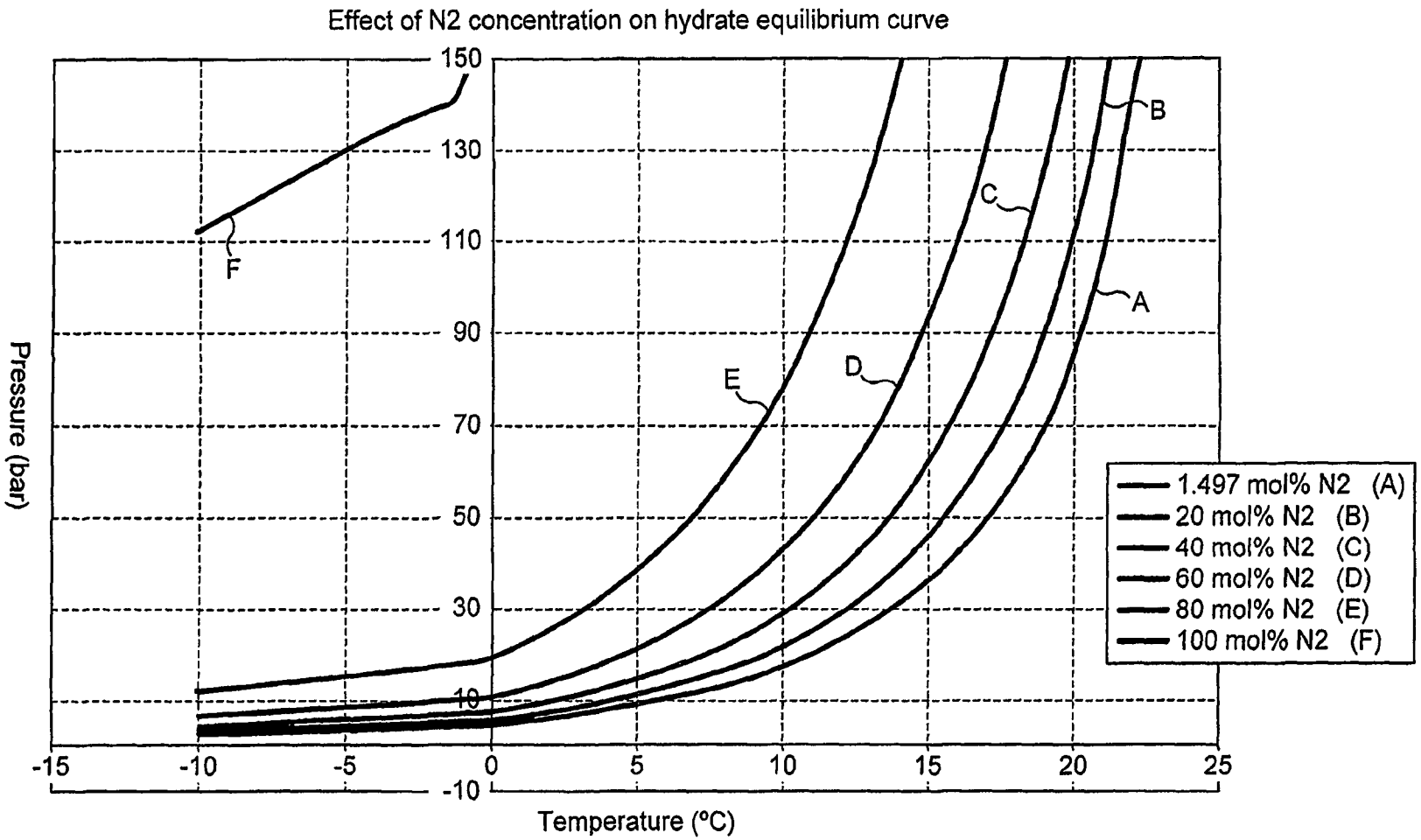

| | | | | |
|---|---|---|---|---|
| 4,856,593 | A | 8/1989 | Matthews et al. | |
| 5,076,364 | A | 12/1991 | Hale et al. | |
| 5,168,933 | A | 12/1992 | Pritchard, Jr. et al. | |
| 5,351,756 | A | 10/1994 | Minkkinen et al. | |
| 5,536,893 | A | 7/1996 | Gudmundsson | |
| 5,600,044 | A | 2/1997 | Colle et al. | |
| 5,639,313 | A | 6/1997 | Khalil | |
| 5,762,149 | A | 6/1998 | Donovan et al. | |
| 5,824,160 | A | 10/1998 | Khalil et al. | |
| 5,879,561 | A | 3/1999 | Klomp et al. | |
| 5,891,262 | A | 4/1999 | Khalil et al. | |
| 6,035,933 | A * | 3/2000 | Khalil et al. | 166/263 |
| 6,076,278 | A * | 6/2000 | Bradley | 34/329 |
| 6,253,855 | B1 | 7/2001 | Johal et al. | |
| 6,307,191 | B1 | 10/2001 | Waycuilis | |
| 6,694,768 | B2 | 2/2004 | Lu | |
| 6,772,840 | B2 | 8/2004 | Headworth | |
| 6,776,188 | B1 | 8/2004 | Rajewski | |
| 6,978,837 | B2 | 12/2005 | Yemington | |
| 7,008,466 | B2 | 3/2006 | Collins | |
| 7,264,653 | B2 | 9/2007 | Panchalingam et al. | |
| 2003/0170077 | A1 | 9/2003 | Herd et al. | |
| 2003/0178195 | A1 * | 9/2003 | Agee et al. | 166/248 |
| 2005/0072574 | A1 | 4/2005 | Appleford et al. | |
| 2006/0115332 | A1 | 6/2006 | Abney et al. | |
| 2009/0111715 | A1 * | 4/2009 | Ballard et al. | 507/90 |

FOREIGN PATENT DOCUMENTS

| | | | |
|---|---|---|---|
| EA | 200802280 | | 9/2005 |
| EP | 0909873 | A2 | 4/1999 |
| EP | 0923998 | A2 | 6/1999 |
| GB | 0605323.5 | | 3/2006 |
| RU | 2264530 | | 11/2005 |
| SU | 648795 | A1 | 2/1979 |
| SU | 1350477 | A2 | 11/1987 |
| SU | 1456204 | A1 | 2/1989 |
| WO | WO-00/17484 | A1 | 3/2000 |
| WO | WO 0017484 | * | 3/2000 |
| WO | WO 2005042675 | A2 * | 5/2005 |
| WO | 2005/003494 | | 9/2005 |
| WO | 2007/000897 | | 3/2007 |

OTHER PUBLICATIONS

Kostin, A.I. et al., "Membrannye azotyne ustanovki v refte-gazovoi promyshlennosti," Sfera Neftegaz, 2006, Special Issue No. 1.

Kostin, A.I. et al., "Memrannoe vozduho-gazorazdelenie v neftyanoi promyshlennosti," Territoriya Neftegaz, 2005, vol. 12.

Supplemental Response/Rule 132 Affidavit filed on Jul. 14, 2011 for U.S. Appl. No. 11/661,836, filed Sep. 24, 2007 (First Inventor—Kinnari).

Response after Non-Final Rejection filed on Jul. 5, 2011 for U.S. Appl. No. 11/661,836, filed Sep. 24, 2007 (First Inventor—Kinnari).

Examiner Interview Summary Record issued on May 27, 2011 for U.S. Appl. No. 11/661,836, filed Sep. 24, 2007 (First Inventor—Kinnari).

Non-Final Rejection issued on Jan. 4, 2011 for U.S. Appl. No. 11/661,836, filed Sep. 24, 2007 (First Inventor—Kinnari).

Response after Non-Final Rejection filed on Aug. 11, 2010 for U.S. Appl. No. 11/661,836, filed Sep. 24, 2007 (First Inventor—Kinnari).

Non-Final Rejection issued on May 11, 2010 for U.S. Appl. No. 11/661,836, filed Sep. 24, 2007 (First Inventor—Kinnari).

Amendment Submitted with CPA/RCE filed Apr. 16, 2010 for U.S. Appl. No. 11/661,836, filed Sep. 24, 2007 (First Inventor—Kinnari).

Final Rejection issued on Oct. 16, 2009 for U.S. Appl. No. 11/661,836, filed Sep. 24, 2007 (First Inventor—Kinnari).

Response after Non-Final Rejection filed on Jul. 14, 2009 for U.S. Appl. No. 11/661,836, filed Sep. 24, 2007 (First Inventor—Kinnari).

Non-Final Rejection issued on Apr. 14, 2009 for U.S. Appl. No. 11/661,836, filed Sep. 24, 2007 (First Inventor—Kinnari).

Preliminary Amendment filed on Mar. 5, 2007 for U.S. Pat. Appl. No. 11/661,836, filed Sep. 24, 2007 (First Inventor—Kinnari).

International Search Report and Written Opinion issued on Jul. 3, 2007 for Intl. App. No. PCT/GB2007/000897, filed on Mar. 14, 2007 (First Inventor—Kinnari; Applicant—Statoil ASA).

International Preliminary Report on Patentability issued on Sep. 16, 2008 for Intl. App. No. PCT/GB2007/000897, filed on Mar. 14, 2007 (First Inventor—Kinnari; Applicant—Statoil ASA).

International Search Report and Written Opinion issued on Nov. 18, 2005 for Intl. App. No. PCT/GB2005/003494, filed on Sep. 9, 2005 (First Inventor—Kinnari; Applicant—Statoil ASA).

International Preliminary Report on Patentability issued on Mar. 13, 2007 for Intl. App. No. PCT/GB2005/003494, filed on Sep. 9, 2005 (First Inventor—Kinnari; Applicant—Statoil ASA).

Search Report under Section 17 issued on Jul. 13, 2006 for UK Pat. App. No. GB0605323.5, filed Mar. 16, 2006 (First Inventor—Kinnari; Applicant—Statoil ASA).

Notification (Official Action from Eurasian Patent Office) issued on Oct. 31, 2007 for EA Pat. App. No. 200700430, which is a national phase of Intl. App. No. PCT/GB2005/003494, filed on Sep. 9, 2005 (First Inventor—Kinnari; Applicant—Statoil ASA).

Eurasian Patent Office Search Report issued on Jun. 15, 2009 for EA Pat. App. No. 200802280, which is a national phase of Intl. App. No. PCT/GB2005/003494, filed on Sep. 9, 2005 (First Inventor—Kinnari; Applicant—Statoil ASA).

Notice of Allowance issued on Sep. 29, 2011 for U.S. Appl. No. 11/661,836, filed Sep. 24, 2007 (First Inventor—Kinnari).

Notice of Allowance issued on Mar. 28, 2012 for U.S. Appl. No. 11/661,836, filed on Sep. 24, 2007.

* cited by examiner

METHOD FOR PROTECTING HYDROCARBON CONDUITS

CROSS REFERENCE TO RELATED APPLICATIONS

The present application is a National Phase Application of International Application No. PCT/GB2007/000897, filed Mar. 14, 2007, which claims priority to Great Britain Patent Application No. 0605323.5, filed Mar. 16, 2006, which applications are incorporated herein fully by this reference.

The present invention relates to improvements in and relating to methods for protecting hydrocarbon conduits, in particular conduits in sub-sea production systems, during periods in which normal hydrocarbon flow is not occurring, e.g. during commissioning or during shutdown, in particular by combating gas hydrate formation.

The well stream from a hydrocarbon reservoir contains water in gaseous or liquid form. At high pressures and low temperatures water can form solid materials in which low molecular weight hydrocarbons, i.e. hydrocarbons which are gaseous at standard temperatures and pressures (STP), are caged. One cubic meter of such a solid can entrap about 180 cubic meters (at STP) of gas. Such materials are normally referred to as "gas hydrates" or simply "hydrates" and will be referred to hereinafter as "hydrates".

For a sub-sea production system, the ambient temperature of the sea water surrounding the conduit (e.g. a "pipeline" or "flow line") from the well head to the water surface, at its lowest is generally about 4° C. At this temperature, hydrates typically form at pressures of about 10 bar. Since the hydrocarbon flow through the conduit will routinely be at a pressure many multiples of this, hydrate formation, which can plug the conduit is a major risk. The temperatures at which hydrate formation occurs may be reached if hydrocarbon flow is reduced or stopped causing the hydrocarbon to cool below the temperature at which hydrate formation occurs, or if the flow path is so long that such cooling will inevitably occur.

If a sub-sea conduit becomes blocked through hydrate plugging, not only does hydrocarbon production cease but unblocking is highly problematical. As mentioned above one cubic meter of hydrate entraps about 180 STP cubic meters of gas—thus simply heating the blocked section of the conduit can cause a pressure surge which may be dangerous or damaging. Due to the serious consequences of a blockage it is common practice to protect the fluid in long (e.g. 40 or more km) sub-sea conduits against hydrate formation by continuous injection at the well head of hydrate inhibitors such as methanol or monoethylene glycol, or to introduce such inhibitors if an unexpected shutdown occurs in shorter conduits, whenever this is possible.

However, not only are such inhibitors expensive but they also reduce the sale price by contaminating the produced hydrocarbon.

Where the hydrocarbon is produced sub-sea through a tall vertically extending (e.g. 500 m and above) rigid riser or through a flexible riser (in the bends of which liquid can pool), the problem of hydrate formation can be particularly severe.

While hydrate formation is particularly problematic in sub-sea production systems, it is of course equally problematic for surface pipelines/flowlines in areas which experience ambient temperature which are below the hydrate formation temperature.

Along the conduit from well-head to sea surface, the insulation efficiency will generally vary. The insulation efficiency is generally expressed as the heat transfer co-efficient U with insulation efficiency being smaller at larger values of U. Typically the U values for jumpers or spools (components of the conduit) may be two or more times greater than the U values for the flowlines (again, components of the conduit). As a result, if flow stops heat loss at the jumpers and spools is greater than at the flowlines and thus the hydrate domain is reached more rapidly so increasing the risk of hydrate formation in these components.

When the production is closed down (whether planned or unplanned) it is therefore important to avoid entering the hydrate domain (i.e. the set of conditions where hydrate formation would occur). One general method of doing this is to reduce the pressure in the conduit so as to avoid the temperature and pressure conditions at any stage of the conduit becoming conducive to hydrate formation. Alternatively, a hydrate inhibitor such as ethylene glycol may be introduced into the flow. Restarting the flow must likewise be carried out carefully so as to avoid creating temperature and pressure conditions conducive to hydrate formation. A further option for avoiding entering the hydrate domain is to maintain the temperature by applying heat to the conduit—this however requires appropriate heating systems to be in place.

Thus there exists a continuing need for improved methods by which hydrate formation, e.g. plug formation, in hydrocarbon conduits may be prevented.

We have now found that by introducing nitrogen into the pipeline at shutdown (e.g. within 1 hour of shutdown) the risk of hydrate formation may be reduced and the time period during which preventative action may successfully be taken can be extended or the need for additional preventative action may be avoided.

Thus viewed from one aspect the invention provides a method of protecting a hydrocarbon conduit during a period of reduced hydrocarbon flow, said method comprising introducing nitrogen into said conduit during a said period at a pressure p of 1 to 350 bar g and at a rate of (1.5 to 35)A kg/sec (where A is the internal cross sectional area of the conduit in square meters) for a period of t hours where $t=(p\times d)/n$ where d is the length in km of the conduit from the nitrogen introduction location and n is 10 to 400, preferably 50 to 350.

Viewed from a further aspect the invention provides a method of protecting a hydrocarbon conduit during a period of reduced hydrocarbon flow, said method comprising introducing nitrogen into said conduit during a said period at a pressure p of 1 to 350 bar g and at a rate of 0.1 to 50 kg/sec for a period of t hours where $t=(p\times d)/n$ where d is the length in km of the conduit from the nitrogen introduction location and n is 10 to 400, preferably 50 to 350.

Viewed from a yet further aspect the invention provides a method of protecting a hydrocarbon conduit during a period of reduced hydrocarbon flow, said method comprising introducing nitrogen into said conduit during a said period at a pressure p of 1 to 350 bar g and at a rate of 0.1 to 50 kg/sec.

The period of reduced hydrocarbon flow in the method of the invention may be a period before hydrocarbon flow has began, e.g. during commissioning, or a period of planned or unplanned shutdown. In the latter case, nitrogen introduction is preferably started shortly before, during or shortly after shutdown (e.g. within one hour of shutdown) and/or before start up. The conduit may if desired be depressurised and in this event nitrogen may be introduced at a low pressure, e.g. as low as 1 bar g, e.g. 1 to 20 bar g. Normally however introduction will be at an elevated pressure, e.g. 20 to 350 bar g, especially 30 to 300 bar g, particularly 40 to 200 bar g, more particularly 50 to 100 bar g.

The time period t is preferably 0.5 to 20 hours, especially 1 to 10 hours.

The hydrocarbon conduit treated according to the invention may be any length but typically will be up to 200 km, preferably up to 50 km, especially up to 20 km, e.g. 1 m to 20 km.

The conduit treated according to the invention may be a conventional pipe or flow line or may be or include any component of the line from well head to end zone, e.g. wells, templates, jumpers, spools, risers, subsea processing facilities, topside facilities, on-shore facilities, separator tanks and other vessels between the well and the end zone, etc.

Treatment according to the invention will generally only be effected when the ambient temperature at the conduit (or any part thereof) is such that hydrate formation could occur.

In the method of the invention, pressure is preferably 50 to 200 bar, (p×d)/t is preferably 100 to 200, (p×d) is preferably less than 2000, and r is preferably 0.5 to 50 kg/sec (most preferably 1 to 30 kg/sec). Where the method of the invention is used to treat a relatively small section of a conduit, e.g. template, jumper, spool, treatment facility, etc., the nitrogen may be applied at relatively low rates, e.g. 0.1 to 5 kg/sec, preferably 0.5 to 2 kg/sec.

The hydrocarbon normally flowing in the conduit is preferably natural gas which will generally contain some water.

The conduit conveniently will have an internal diameter of 0.5 to 40 inches, but more typically will have an internal diameter of 5 to 30 inches.

In the method of the invention, the direction of hydrocarbon flow is the direction in which the hydrocarbon flows in normal operation.

The nitrogen, which is preferably at least 90% mole pure, preferably contains less than 10% mole oxygen, especially preferably less than 5% mole, more particularly less than 2% mole.

The use of nitrogen to inhibit hydrate formation in this way is counter-intuitive since it is itself be capable of forming hydrates.

The nitrogen pressure and flow rate should be monitored and adjusted to ensure hydrate formation does not occur. Typically it will be added in quantities such that up to 100% mole of the fluid within the conduit immediately downstream of the gas injection site is nitrogen. Desirably the figure will be at least 25% mole, more preferably at least 40% mole, especially at least 60% mole, more especially at least 80% mole, e.g. up to 99% mole, more preferably up to 95% mole.

It is nevertheless desirable that that portion of the fluid flow that contains the nitrogen should be combustible and accordingly the quantity added may be kept to a level which permits this or alternatively hydrocarbon (e.g. methane, natural gas, etc.) may be added to the fluid flow downstream of nitrogen introduction to bring down the relative concentration of nitrogen gas. Such hydrocarbon introduction should of course take place at a point where there is no risk of hydrate formation, or after restarting flow after a depressurization.

The method of the invention is especially suitable for use with sub-sea wells, in particular for preventing hydrate formation in one or more of the components in the conduit from well-head to above the water surface, especially jumpers (connections from well-head to manifold or template), manifold, template, spools (expandable joints within the conduit), flowlines and both flexible and rigid risers. It may also be used within the sections of the well where the ambient temperature of the surrounding formation is low enough to permit hydrate formation (e.g. down to about 100 m below the mudline) and in above-surface sections of a conduit.

The method of the invention may also advantageously be used in the annulus section of the well design. Normally, the annulus pressure is controlled by using methanol or glycol. Use of nitrogen as described herein will provide an alternative solution. Any leakage of the well stream into the annulus bleed line would thus be inhibited by the nitrogen. Another advantage with using the nitrogen is that it will accommodate in a more effective way for thermal volume expansions than would a liquid filled annulus bleed line.

In the case of an unplanned shut-down, the nitrogen is preferably introduced at one or more sites along the conduit, especially preferably sites upstream of one or more of jumpers, templates, manifolds, spools or risers, before, during or after depressurization. Introduction of the nitrogen in this way serves to extend the cool down time for sections of the conduit with high U values, i.e. sections particularly at risk of hydrate formation. Cool down time (CDT) is one of the key design factors and is the time a given structure will take to reach hydrate-forming conditions from production conditions. CDT requirements vary from field to field but usually are more stringent for deep-water than shallow-water applications. The addition of the nitrogen reduces the hydrate equilibrium temperature, automatically prolonging CDT and allowing more time for implementation of hydrate control measures. With the use of the method of the invention in this way, it is alternatively possible to reduce the insulation requirements for the components of the conduit and hence to reduce their cost.

During a planned or unplanned shut-down, introduction of the nitrogen may also be used to reduce the need to depressurize the initially hydrate-free areas of the conduit. Thus for example for typical operating conditions where the flowing hydrocarbon has a temperature of 18° C. and the ambient seawater temperature is 4 to 5° C. shut down would involve depressurizing from 200 bar to about 10 bar. If nitrogen is added to a concentration of about 60% mole, depressurization to about 20 bar will suffice while for nitrogen addition to a concentration of about 90% mole depressurization to about 50 bar may suffice.

Nitrogen introduction may be affected relatively simply by providing a valve line from a nitrogen source to the desired introduction sites on the conduit or within the bore. Such lines are desirably thermally insulated and it may be desirable to heat the nitrogen before injection, e.g. on transit to the injection site. Nitrogen may typically be introduced from a nitrogen generator or nitrogen reservoir (e.g. a liquid or pressurized nitrogen tank). Introduction may be operator controlled; however automatic introduction, i.e. computer-controlled in response to signals from flow monitors, will generally be desirable.

The nitrogen will generally be introduced under normal shut-in pressure, e.g. 50 to 250 bar. The nitrogen may alternatively be introduced into a partially or totally depressurized conduit, in which case a lower introduction pressure may suffice. In any event, the line from gas source to conduit introduction point will generally be provided with pumps and/or compressors.

Where the nitrogen is used during depressurization, the quantity added and the rate at which it is added should be matched to the depressurization profile and the insulation characteristics of the conduit so as to ensure that the pressure and temperature conditions do not become conducive to hydrate formation. Likewise during repressurization it will generally be desirable to add nitrogen and similarly match the quantity added to the repressurization profile. In many cases it may be desirable to flush the conduit (e.g. from the well-head or other selected sites) with nitrogen before hydrocarbon flow is restarted. Moreover it may be desirable to add a chemical inhibitor (e.g. glycol) to the hydrocarbon during repressurization.

One particular region of the conduit in which use of the method of the invention is especially favourable is in risers where gas lift is required.

Gas lift is used to drive liquid up tall deepwater risers. When depressurized, the residual fluid in such risers may create a pressure which is far above that at which, under ambient temperature conditions, hydrate formation occurs at the base of the riser. In normal operation, gas (generally natural gas) is injected into the hydrocarbon flow at or near the riser base to drive the liquid up and out of the riser. In the method of the invention, before, during or after depressurization the gas lift gas may be switched to being nitrogen so as to minimize the possibility of the riser retaining sufficient liquid as to cause hydrate formation when depressurization is completed. Before and during repressurization the riser may likewise be flushed with nitrogen. Particularly preferably nitrogen flow in the riser is maintained during shutdown. This use of the method of the invention is particularly useful with risers having a vertical length of 100 m or more, especially 250 m or more, more especially 500 m or more.

The invention also provides apparatus for operation of the method of the invention. Viewed from this aspect the invention provides a hydrocarbon transfer apparatus comprising a conduit for hydrocarbon flow having a hydrocarbon inlet valve and a hydrocarbon outlet valve, an inhibitor gas source, and a valved line from said source to an inlet port within said conduit, said line optionally being provided with a pump.

The components of the apparatus of the invention may include any of the components encountered in the hydrocarbon conduit from a hydrocarbon well-bore to above the water surface.

Particularly desirably the hydrocarbon conduit will be provided with nitrogen inlets, valves and vents at a plurality of positions along its length so that the section of the conduit to be treated with the method of the invention may be selected as desired, i.e. so that a limited volume of the conduit may be treated if desired.

Nitrogen flushing, e.g. using the parameters discussed above, may be used to protect a hydrocarbon flow conduit before production (i.e. hydrocarbon flow) begins, e.g. during commissioning or first time start up. This forms a further aspect of the invention and is applicable even for extremely long conduits, e.g. up to 2000 km, particularly up to 1000 km. Viewed from this aspect the invention provides a method for protection of a hydrocarbon flow conduit which method comprises flushing said conduit with nitrogen prior to commencement of hydrocarbon flow.

The invention will now be illustrated with reference to the accompanying drawings in which:.

FIG. 1 is a plot of a phase diagram for hydrate and gas (or hydrocarbon)/water at various levels of nitrogen content (the lines are respectively the hydrate equilibrium curves at (1) 100% mole nitrogen; (2) 95% mole nitrogen; (3) 90% mole nitrogen; (4) 80 mole nitrogen (5) 60 mole nitrogen; (6) 40 mole nitrogen; (7) 20 mole nitrogen; and 1.5% mole nitrogen); and FIG. 2 is a schematic diagram of a sub-surface hydrocarbon well equipped to perform the method of the invention.

Referring to FIG. 1 it may be seen that by increasing the nitrogen content of a hydrocarbon flow to 80% mole (for example), the hydrate equilibrium pressure at 4° C. is increased from about 4 bar to about 30 bar (for the hydrocarbon mixture used).

Figure 2:
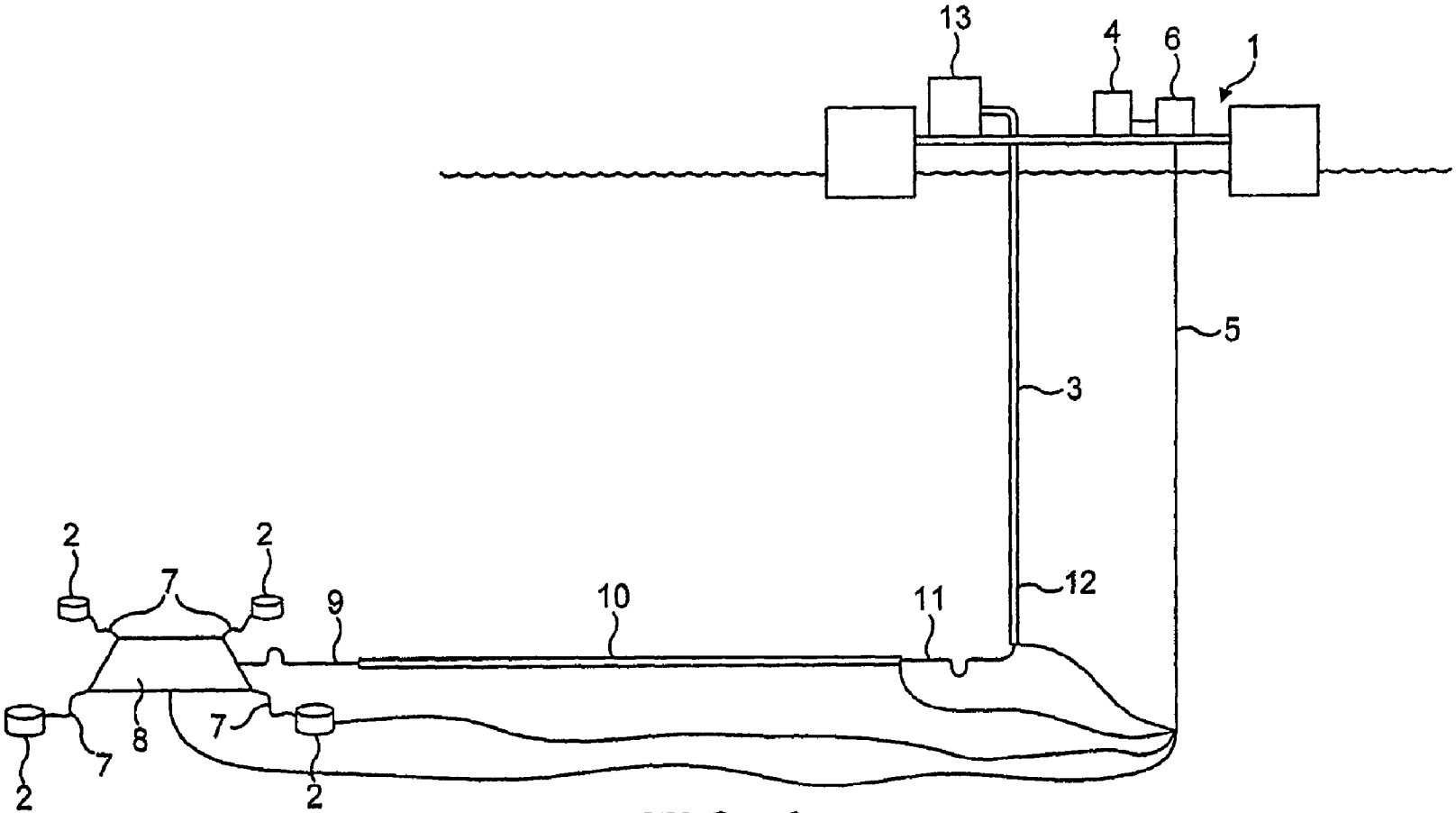

Referring to FIG. 2 there is shown a sea level platform 1 linked to sea bed well-heads 2 via a conduit 3. Platform 1 is provided with a nitrogen generator 4 and a nitrogen line 5 equipped with pump 6 and valves (not shown). The well-heads 2 are connected by jumpers 7 to a template 8. Template 8 is connected via a spool 9 to flowline 10. Flowline 10 is connected via a spool 11 to a rigid riser 12. Hydrocarbon flowing from rigid riser 12 is fed to a reservoir 13 at the surface.

Before, during or after depressurization or before or during repressurization, nitrogen from generator 4 may be injected into conduit 3 upstream of jumpers 7 and spools 9 or 10, or as a gas lift gas into the base of riser 12.

The invention claimed is:

1. A method of protecting a hydrocarbon conduit from hydrate formation during a period of reduced hydrocarbon flow, said method comprising introducing nitrogen into said conduit during a said period at a pressure p of 1 to 350 bar g and at a rate of (1.5 to 35)A kg/sec (where A is the internal cross sectional area of the conduit in square meters) for a period of t hours where $t=(p\times d)/n$ where d is the length in km of the conduit from the nitrogen introduction location and n is 10 to 400, and wherein if the pressure in the conduit at shutdown is such that $(p\times d)$ is greater than 2000, the pressure is reduced to reduce $(p\times d)$ to 2000 or less.

2. A method as claimed in claim 1 where $(p\times d)$ is less than 2000.

3. A method as claimed in claim 1 wherein nitrogen introduction is effected within 1 hour of shutdown.

4. A method as claimed in claim 1 wherein $(p\times d)/t$ is in the range 100 to 200.

5. A method as claimed in claim 1 wherein t is 0.5 to 20 hours.

6. A method as claimed in claim 1 wherein r is 0.5 to 50 kg/sec.

7. A method as claimed in claim 1 wherein r is 1 to 30 kg/sec.

8. A method as claimed in claim 1 wherein the nitrogen is at least 90 mole % pure.

9. A method as claimed in claim 1 wherein the hydrocarbon is natural gas.

10. A method as claimed in claim 1 wherein the ambient temperature outside said conduit is less than the hydrate equilibrium temperature for the pressure within and the contents of the conduit, e.g. below 30° C., more generally below 18° C., especially below 5° C.

* * * * *